US007650664B2

(12) United States Patent
Henderson et al.

(10) Patent No.: US 7,650,664 B2
(45) Date of Patent: Jan. 26, 2010

(54) DISPOSABLE CLEANING PAD AND HANDLE THEREFOR

(75) Inventors: Marianne Henderson, Philadelphia, PA (US); Ruth Levy, Collegevolle, PA (US); Diane Massaglia, New Hope, PA (US); Anita Heft, Pottstown, PA (US)

(73) Assignee: First Quality Retail Services, LLC, Great Neck, NY (US)

( * ) Notice: Subject to any disclaimer, the term of this patent is extended or adjusted under 35 U.S.C. 154(b) by 0 days.

(21) Appl. No.: 11/726,154

(22) Filed: Mar. 21, 2007

(65) Prior Publication Data

US 2007/0214591 A1 Sep. 20, 2007

Related U.S. Application Data

(63) Continuation-in-part of application No. PCT/US2006/043666, filed on Nov. 10, 2006.

(60) Provisional application No. 60/735,580, filed on Nov. 12, 2005.

(51) Int. Cl.
*A47L 13/10* (2006.01)

(52) U.S. Cl. ..... 15/210.1; 15/209.1; 15/229.3

(58) Field of Classification Search ..... 15/209.1, 15/208, 247, 229.1, 229.2, 229.3, 229.4
See application file for complete search history.

(56) References Cited

U.S. PATENT DOCUMENTS 5,692,261 A * 12/1997 Lops ..... 15/209.1
5,953,784 A * 9/1999 Suzuki et al. ..... 15/209.1
6,813,801 B2 * 11/2004 Tanaka et al. ..... 15/229.3
6,968,591 B2 * 11/2005 Tanaka ..... 15/229.1
7,234,193 B2 * 6/2007 Tanaka et al. ..... 15/229.3
7,302,730 B2 * 12/2007 Tanaka et al. ..... 15/229.3
2003/0000039 A1 * 1/2003 Borcherds ..... 15/209.1
2004/0074033 A1 * 4/2004 Steinberg ..... 15/144.4
2007/0214591 A1 * 9/2007 Henderson et al. ..... 15/209.1
2008/0047087 A1 * 2/2008 Levy et al. ..... 15/210.1

* cited by examiner

*Primary Examiner*—Lee D Wilson
(74) *Attorney, Agent, or Firm*—Amster, Rothstein & Ebenstein LLP

(57) ABSTRACT

The present invention discloses an economical and disposable cleaning tool which may be prepared by a simplified manufacturing process involving a reduced number of steps. The cleaning tool comprises a cleaning pad and a handle, the cleaning pad having a pocket for receiving the handle. The cleaning pad may be provided with a top sheet and a fiber bundle. The top sheet is folded over and bonded to provide a cleaning portion and a back portion, and the fiber bundle is disposed on the cleaning portion. The cleaning portion and the back portion of the folded sheet are bonded together forming the pocket for the handle to be disposed therein. The handle may include a hinge to enable the handle to be repeatedly folded over for convenient storage or easily extended for use.

45 Claims, 7 Drawing Sheets

DISPOSABLE CLEANING PAD AND HANDLE THEREFOR

CROSS-REFERENCE TO RELATED APPLICATIONS

This application is a continuation-in-part to PCT Application PCT/US/2006/043666 filed on Nov. 10, 2006 which claims benefit of priority to Provisional Application Ser. No. 60/735,580 filed Nov. 12, 2005.

BACKGROUND OF THE INVENTION

The present invention relates to disposable cleaning tools. More particularly, the present invention describes an economical disposable cleaning pad with desired dust wiping and trapping capability, as well as a handle.

Cleaning articles of the hand duster type are typically used in households for dusting furniture, decorative articles, and the like. These cleaning articles can either be as simple as a single dusting cloth or may have a fluffy cleaning pad or brush portion made of one or more sheets for wiping off the dust from the surface of the object to be cleaned. The cloth or pad is sometimes attached to a handle, allowing the user to clean places which are hard to reach.

Different types of hand dusters are manufactured and are available in the market. One of the most commonly used hand dusters is one with a brush portion made of fibers. The fibers in the brush increase the dust trapping ability of the cleaning article.

U.S. Pat. No. 4,145,787, issued to Bastian et al., discloses a hand duster comprising a relatively large fluffy spherical shaped head, a handle and a wire means to retain the head towards one end of the handle. The head consists of a very large number of fine, flexible, coextensively juxtaposed fibers extending from a central region of the head. However, since the head portion of the described duster has only fibers, it is not very durable. Fibers in the head portion may get entangled or curled during the cleaning process. As a result, the head portion gets compressed and the duster becomes less effective during continued use.

In another type of a cleaning article, the brush portion is made up of twisted yarns of cotton or like materials. The twisted yarns trap dust more efficiently when an adhesive oil agent, such as liquid paraffin, is applied to their surface. Moreover, these yarns are costly and hence the cleaning articles made of twisted yarns are not an economical choice for cleaning articles which are to be disposed of after one use.

Cleaning articles having laminated non-woven fabric sheets are also currently manufactured. In these cleaning articles, one or more such sheets are laminated and their peripheral portions are unattached to each other, keeping these portions loose to wipe the surface of the object to be cleaned.

In another variation of these cleaning articles, the peripheral portions are cut to form a duster portion having long strips. Since non-woven fabrics are good for wiping dust and are also not very expensive, these fabrics are suitable raw materials for making disposable cleaning articles. However, the cleaning articles formed in such a manner are flat and hence the desired dust trapping capability is not optimized.

U.S. Pat. No. 6,813,801, issued to Tanaka et al., discloses a cleaning article having a brush portion. The brush portion of the described cleaning article is provided with two or more non-woven sheets and fiber bundle layers. In some embodiments of the cleaning articles, the non-woven sheets are provided with strips which are described as increasing the rigidity of the brush portion and preventing entanglement of the fibers. However, the use of a large number of sheets as a constituent not only increases the manufacturing cost and inventory overhead of the cleaning article, but also complicates the manufacturing process.

As mentioned above, various types of cleaning articles are currently being manufactured and sold. However, a need exists for a disposable cleaning article that is less expensive to manufacture and has optimal dust wiping and trapping capability.

It is therefore desirable to make disposable cleaning articles using simplified manufacturing process steps, and hence to reduce the manufacturing cost and provide an economical and durable disposable cleaning article with the desired dust wiping and trapping capability.

SUMMARY OF THE INVENTION

It is an object of the present invention to provide an economical and durable disposable cleaning tool.

It is a further object of the invention to manufacture a cleaning tool using a reduced number of steps to simplify the manufacturing process.

It is yet another object of the present invention to provide a cleaning tool with improved dust wiping and trapping capabilities.

It is a further object of the present invention to provide a cleaning tool that can be stored in a minimum amount of space.

The present invention discloses a disposable cleaning tool comprising a an economical disposable cleaning pad with desired dust trapping and wiping ability and an implementing means. The disclosed cleaning pad may be prepared using simplified reduced manufacturing process steps and thus has a reduced manufacturing cost. The implementing means may comprise a foldable handle. The handle may be held within the cleaning pad by means of frictional engagement.

According to an embodiment of the present invention, the cleaning pad is constructed with a top sheet and a fiber bundle. In the present cleaning pad, the top sheet is folded over, forming a cleaning portion and a back portion, while at the same time providing a pocket for attachment of a handle to the cleaning pad. Depending on the configuration of the pocket, a user may alternatively insert his or her hand into the pocket for using the cleaning pad. The handle may include a hinge, or may be of two-piece construction, for convenient folding and storage.

The fiber bundle is disposed on the cleaning portion of the top sheet. The fiber bundle is preferably at least partially joined to the top sheet. In this way, disaggregation or entanglement of fibers forming the fiber bundle is suppressed. The cleaning pad may additionally be provided with a bottom sheet adjacent the fiber bundle opposite the top sheet, enhancing the contact between the cleaning pad and the object which is to be cleaned.

In the cleaning pad according to a first embodiment of the invention, the cleaning portion and the back portion of the top sheet are joined together forming an empty space or pocket. The empty space thus constructed is configured to provide a pocket into which a handle, a users hand or other implementing means can be inserted. The fiber bundle is also at least partially attached to the cleaning portion of the top sheet. In the cleaning pad thus constructed, the fiber bundle is partially fixed during the cleaning operation, so that the cleaning pad is of durable construction.

In this configuration, the fiber bundle appears on the outermost face of the cleaning pad and can thus conform to the irregular shape of the object to be cleaned. This improved contact enhances the fine dust wiping capability of the cleaning pad.

According to a second embodiment of the invention, the cleaning pad is additionally provided with a second or bottom sheet. The bottom sheet may include a plurality of strips. The bottom sheet is disposed adjacent the fiber bundle and appears as the outermost surface of the cleaning pad. The bottom sheet increases the wiping ability of the cleaning tool. While the cleaning pad is in use, the cleaning sheet wipes the dust particles, which are then trapped by the fiber bundle.

In a third embodiment of the invention, the cleaning pad comprises a top sheet and a third or middle sheet, either or both having a plurality of strips, and two fiber bundles. The top sheet and the first fiber bundle are configured in the same manner as previously described for the other embodiments. In this embodiment, the middle sheet may be disposed in between the two fiber bundles thus providing greater strength and durability to the fiber bundles of the cleaning pad. The second or bottom sheet may also be included.

According to a fourth embodiment the present invention, the top sheet is folded over and bonded to form two outer surfaces and two inner surfaces and a sleeve into which an implementing means is inserted. The two inner surfaces thus formed are facing each other, and the two outer surfaces are facing opposite each other. A pair of fiber bundles are provided, one disposed on each of the outer surfaces, thereby forming dual cleaning surfaces for the cleaning tool. During cleaning operations, the first fiber bundle on a first cleaning surface is usually made to come in contact with the object to be cleaned. However, the back portion also exhibits dust wiping capabilities and may be used as and when required, such as when inserting the cleaning pad into narrow spaces. Also, the cleaning pad can either be removed from the implementing means and rotated to utilize the second cleaning surface, or the handle merely rotated depending upon the configuration of the handle. The handle may also include a rotating member to flip over the cleaning pad.

In a fifth embodiment of the invention of the present invention, the top sheet is folded in a generally Z-shaped configuration along the longitudinal dimension. The Z-shaped fold creates at least two (2) pockets for insertion of a handle. The top sheet is longitudinally bonded, generally along the Z-shaped fold, with a fiber bundle operatively attached to the top sheet.

In any of the above configurations of the cleaning pad, a pocket may be formed by folding over of the top sheet. In this pocket, a user may insert his or her hand or a handle may be inserted.

It is preferred that the fiber bundle is partially joined to the top sheet so that the fiber bundle moves together with the top sheet and hence the individual fibers can be prevented from being entangled or massed. The use of the second or bottom sheet can also help reduce deformation of the individual fibers of the fiber bundle.

It is preferred that the top sheet, bottom sheet and the middle sheet are made of either a non-woven fabric comprising thermoplastic fibers or a thermoplastic resin film. Preferably, the fiber bundle comprises heat-fusible thermoplastic fibers. All these elements (i.e., top sheet, bottom sheet, middle sheet and the fiber bundle) can be joined to each other easily and quickly by heat fusing. If continuous thermoplastic fibers are used for forming the sheets, the non-woven fabric can be manufactured by a point bonding process, referred to as "spun bond", to have high rigidity and elasticity. If staple thermoplastic fibers are used for forming the sheets the non-woven fabric can be manufactured by a point bonding

BRIEF DESCRIPTION OF THE DRAWINGS

Various other objects, features and advantages of the invention will become more apparent by reading the following detailed description in conjunction with the drawings, which are shown by way of example only, wherein.

DETAILED DESCRIPTION OF THE PREFERRED EMBODIMENTS

The following terms have the following meanings as used in the context of the present invention, unless expressly indicated to the contrary:

"Cleaning tool" refers to devices comprising a cleaning pad and an implementing means, which is intended to be used for cleaning, wiping or sweeping purposes.

"Cleaning pad" defines the component performing cleaning, wiping or sweeping, and is made of one or more sheets and a fiber bundle.

"Cleaning face/side/surface" refers to faces/sides/surfaces which are intended to be directed to the surface of the object to be cleaned or swept.

"Fiber bundle" refers to a loosely bonded sheet of fibers. Examples of fibers include filaments, flat yarns, split yarns and the like. Unless otherwise noted, these fibers are not heat-fused to one another in the fiber bundle.

"Folded over" refers to folding a sheet in a generally Z- or C-shape such that a space is created between the folds of the sheet.

"Longitudinal centerline" refers to the axis or direction in the plane of a sheet which generally separates the sheet into left and right transverse portions.

Strip" refers to a long, relatively narrow piece of a sheet.

The present invention will now be described with reference to the accompanying drawings, wherein like numerals refer to similar components throughout the various drawings. The drawings are being used to illustrate the inventive concept, and are not intended to limit the invention to the particular embodiments illustrated.

Figure 1:
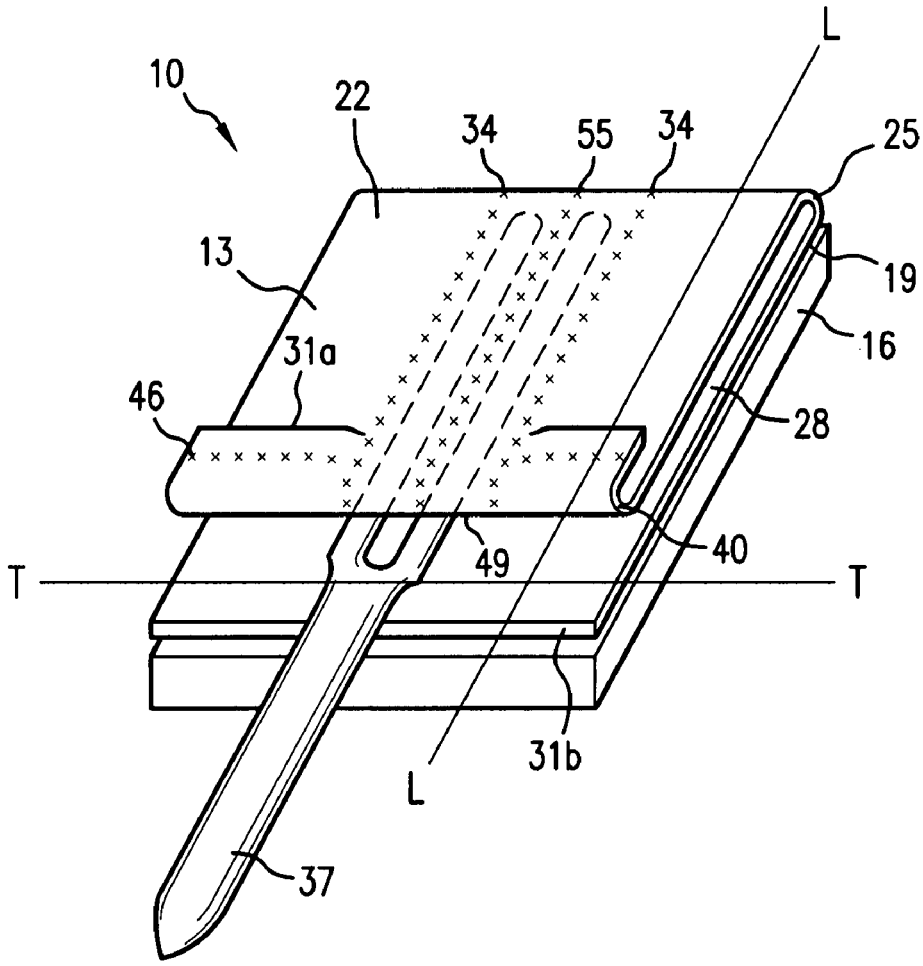
FIG. 1 is a perspective view of a cleaning tool according to a first embodiment of the present invention.
Figure 2:
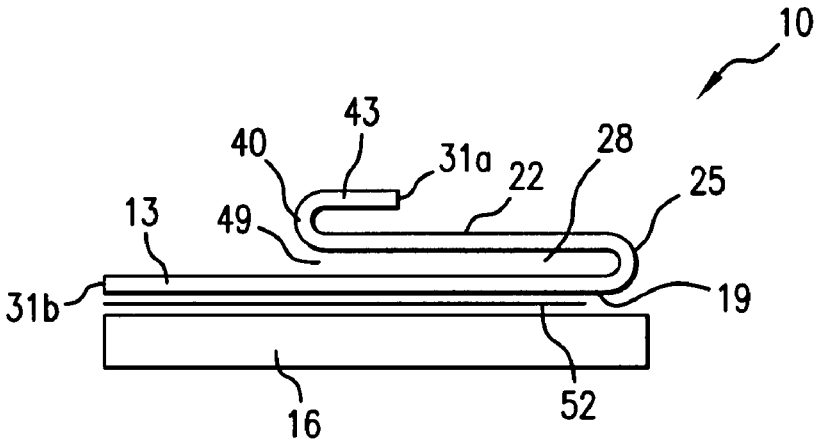
FIG. 2 is a side view of the cleaning pad of FIG. 1.

FIGS. 1 and 2 show a cleaning pad 10 according a first embodiment of the present invention comprising a top sheet 13 and a fiber bundle 16. As shown in FIGS. 1 and 2, the top sheet 13 comprises a cleaning portion 19 and a back portion 22 separated by a fold line 25; the fold line 25 having a generally C-shaped configuration. The C-shaped fold of the top sheet 13 forms a pocket 28 between the cleaning portion 19 and the back portion 22. The fiber bundle 16 is disposed adjacent to the cleaning portion 19. As shown in FIG. 2, the overall length of the top sheet 13 is chosen such that, when folded, the longitudinal end 31*a* of the back portion 22 opposite to the fold line 25 is not coterminous with the longitudinal end 31*b* of the cleaning portion 19 (see also FIG. 4). It will be understood by those skilled in the art that the length of the top sheet 13 can chosen such that the edges are coterminous (see, for example, the embodiment shown in FIGS. 7 and 8) and that the longitudinal end 31*a* can be of any length. Preferably the longitudinal end 31*a* of the back portion 22 extends at least 20%, and preferably at least 50%, along the longitudinal dimension of the cleaning portion 19 as measured from the fold line 25.

Preferably, the top sheet 13 and the fiber bundle 16 are bonded together along one or more bond lines 34. In the embodiment shown in FIG. 1, a pair of generally parallel bond lines 34 extends along the longitudinal dimension L-L of the cleaning pad 10, and may be comprised of either continuous or intermittent bond point(s). In this manner, the pocket 28 can be dimensioned to receive a handle 37 in a snug or interference fit to prevent slippage of the cleaning pad 10 with respect to the handle 37 during use.

The embodiment of FIG. 1 also includes an optional second fold line 40 to create a flap portion 43. The flap portion 43 may also include a segmented transverse bond line 46 along transverse direction T-T, which preferably includes an opening 49 for the handle 37.

In manufacturing the cleaning pad 10 shown in FIG. 1, preferably the folded top sheet 13 is disposed adjacent the fiber bundle 16, which are then joined together along the longitudinal bond line(s) 34. Alternatively, the top sheet 13 can be disposed adjacent the fiber bundle 16 with an adhesive material or layer 52 (FIG. 2) therebetween. The adhesive material 52 bonds the fiber bundle 16 to the top sheet 13. The top sheet 13 can then be folded along the fold line 25 to create the cleaning portion 19 and the back portion 22. The longitudinal bond lines 34 and/or the transverse bond line 46 can be provided to create the pocket 28 and/or opening 49 for the handle 37. In addition, preferably a further bond line 55 can be placed along the longitudinal centerline to join the top sheet 13 to the fiber bundle 16, thereby creating two (2) pockets 28 for the handle 37.

Various types of materials used to make the top sheet 13 and the fiber bundle 16 are known to a person of ordinarily skill in the art. For example, the top sheet 13 may be formed of a non-woven fabric which may include thermoplastic fibers (i.e., heat-fusible fibers). Examples of the thermoplastic fibers include: fibers of PE (polyethylene), PP (polypropylene) or PET (polyethylene terephthalate); and conjugated fibers of PE/PET or PE/PP (e.g., conjugated fibers of a core/sheath structure having a core of PP or PET and a sheath of PE). Also, the individual fibers may be constructed of two or more polymer strands co-extruded in a generally side by side configuration. The non-woven fabric may be a thermal bonded non-woven fabric, a spun-bonded non-woven fabrics or a spun-laced non-woven fabric. Alternatively, the top sheet may be formed of a thermoplastic resin film such as a PE film or a PP film. It may also be possible to form the top sheet from a laminated sheet of a non-woven fabric and a resin film.

Preferably, in order to increase elasticity while still providing a durable construction, the top sheet is formed of a point bonded non-woven material referred to as "spun bond". Alternatively a through-air bonded non-woven fabric in which the thermoplastic fibers are bonded by using heated air may be used, or a point bonded non-woven fabric made of thermoplastic staple fibers.

The material of the top sheet preferably should be soft in texture and strong in tensile strength. One particularly suitable material is a spunbond-meltblow-spunbond (SMS) web, available from AVGOL Nonwoven Industries LTD., Holon, Israel. The spunbond layer is made of polypropylene fibers. Such composites provide the advantage of a fabric texture. The non-woven top sheet can also be made of other suitable cloth-like materials, e.g., spun-bond or thermal-bond non-woven web made of either polypropylene, polyethylene, polyester, bi-component fibers (polyethylene/polypropylene or polyethylene/polyester), or any combinations of these fibers. Various multiple layer configurations or fiber denier variations may be used. Another example includes hydro-entangled non-woven webs, which may contain some cotton and/or rayon fibers blending in with thermal-plastic fibers. Cellulose fibers can also be blended in at small percentages to reduce cost. Other materials for forming the top sheet 13 may include polypropylene films, co-extruded films (polyethylene and ethylene vinyl acetate), co-polymer films (polyethylene/polypropylene), and polylaminates (polypropylene non-woven and polyethylene film).

The fiber bundle is preferably made of a synthetic material, such as polypropylene or polyester, manufactured of numerous individual strands into a tow. The individual fibers of the tow are generally positioned in a direction perpendicular to the longitudinal dimension of the cleaning pad. The bonding of the top sheet 13 to the fiber bundle 16 helps prevent disaggregation or entanglement of the individual fiber strands. The individual fiber strands comprising the tow may be made of any suitable materials such as PE, PP, PET, Ne (nylon), rayon, or combinations thereof. The individual fiber strands of the fiber bundles may contain fibers of different finenesses.

However, the fibers forming the fiber bundle of the present invention may not be limited to individual strands or filaments. The fiber bundle may also be made of a flat yarns or split yarns. Additionally, the fibers forming the fiber bundle may be crimped. In crimped fibers, the fiber bundle becomes relatively bulky so as to form a structure capable of capturing dust easily by the crimped portions. The individual strands forming the fiber bundle 16 may be joined to the top sheet 13 in any arrangement such that the motion of the individual strands can be restrained to prevent the strands from being excessively separated or entangled, while at the same time permitting the strands to move over the top sheet 13 relatively freely, thereby exhibiting an excellent dust collecting effect.

Figure 3:
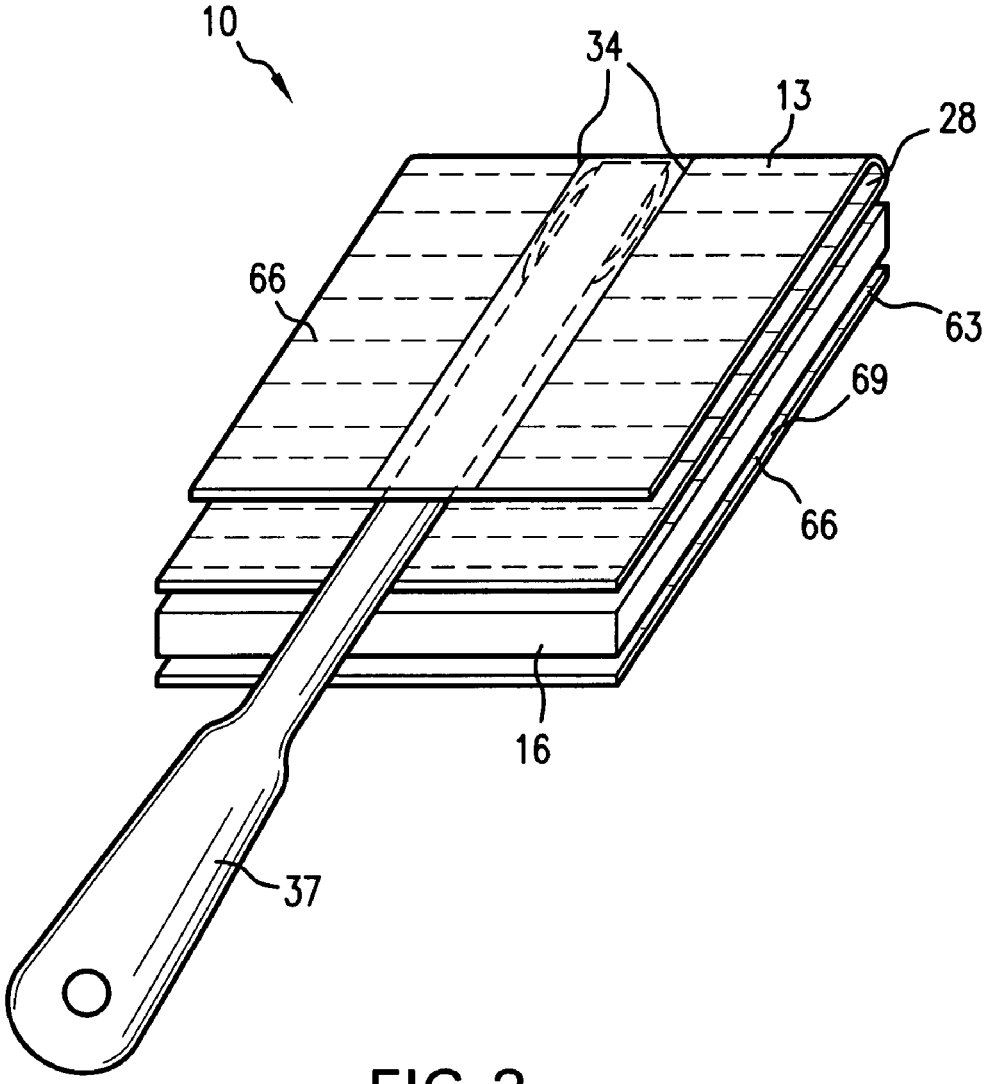
FIG. 3 is a perspective view of a cleaning tool according to a second embodiment of the present invention.
Figure 4:
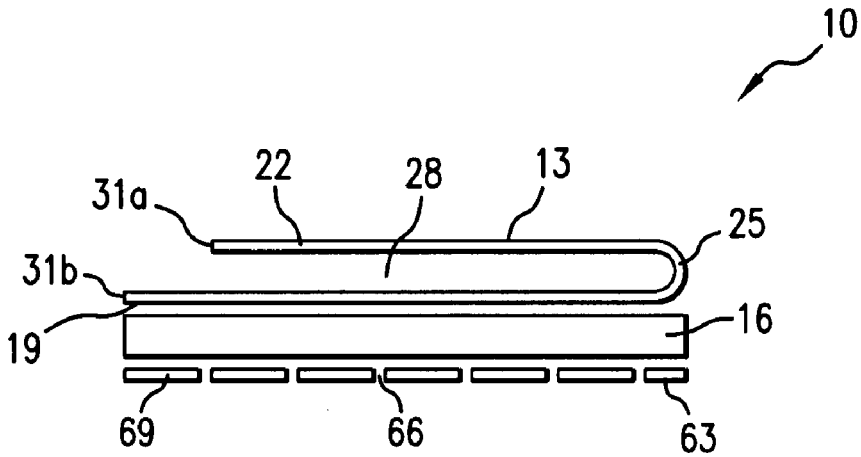
FIG. 4 is a side view of the cleaning pad of FIG. 3.

Referring now to FIGS. 3 and 4, in a second embodiment of the present invention, the cleaning pad 10 comprises the top sheet 13 and the fiber bundle 16. The top sheet 13 is folded over thus forming the cleaning portion 19 and the back portion 22. The fold line 25 therebetween results in the formation of an empty space, which creates a pocket 28 along with bond lines 34. The pocket 28 allows insertion of the handle 37, or a users hand depending upon the transverse spacing of the longitudinally directed bond lines 31. In this embodiment, in contrast to that shown in FIG. 1, the flap portion is not included. Also shown in FIG. 3, a second or bottom sheet 63 is disposed adjacent to the fiber bundle 16 opposite the top sheet 13. The bottom sheet 63 is preferably made of the same material as the top sheet 13, thereby simplifying the manufacturing process. In this embodiment, the fiber bundle 16 can first be integrally bonded to the bottom sheet 63, prior to its mating with the top sheet 13. Also shown in this embodiment, either or both of the top sheet 13 and the bottom sheet 63 may have a plurality of longitudinally spaced, transverse cuts 66 to form strips 69 (which are shown exaggerated in FIG. 4 for clarity). The cuts 66 can have any configuration, thus imparting a similar configuration to the strips 69, such as straight, serrated, curved, elliptical, etc.

Figure 5:
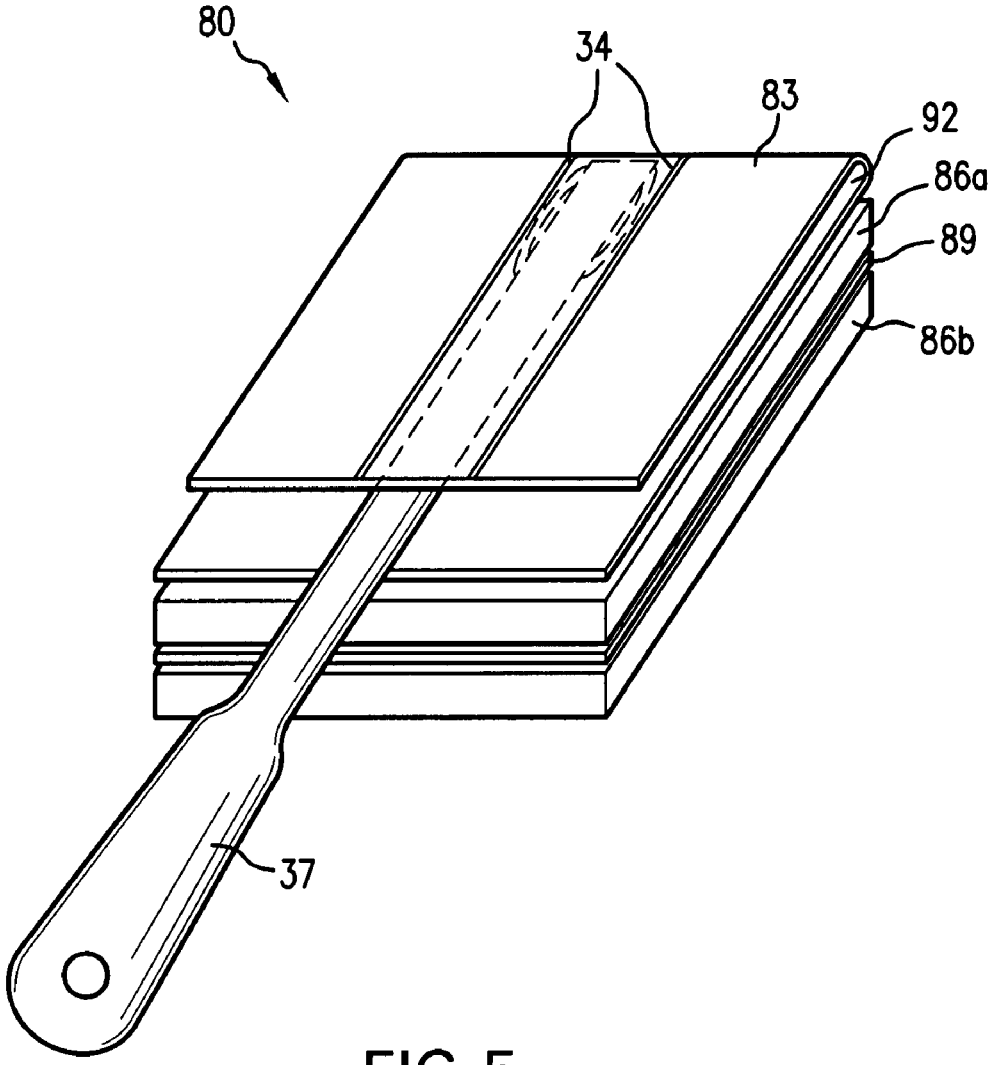
FIG. 5 is a perspective view of a cleaning tool according to a third embodiment of the present invention.
Figure 6:
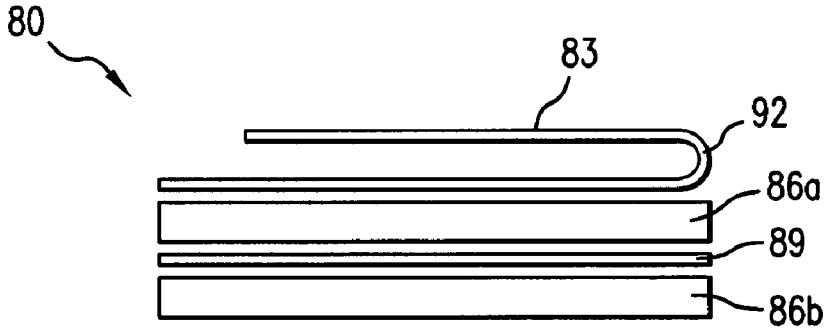
FIG. 6 is a side view of the cleaning pad of FIG. 5.

In a third embodiment of the present invention, as shown in FIGS. 5 and 6, a cleaning pad 80 comprises a top sheet 83 and two (2) fiber bundles 86*a* and 86*b*. Disposed between each of the fiber bundles 86*a* and 86*b* is a third or middle sheet 89. Preferably, the middle sheet is made of the same material as the top sheet 83. In this embodiment, the top sheet 83 includes the C-shaped fold line 92.

Figure 7:
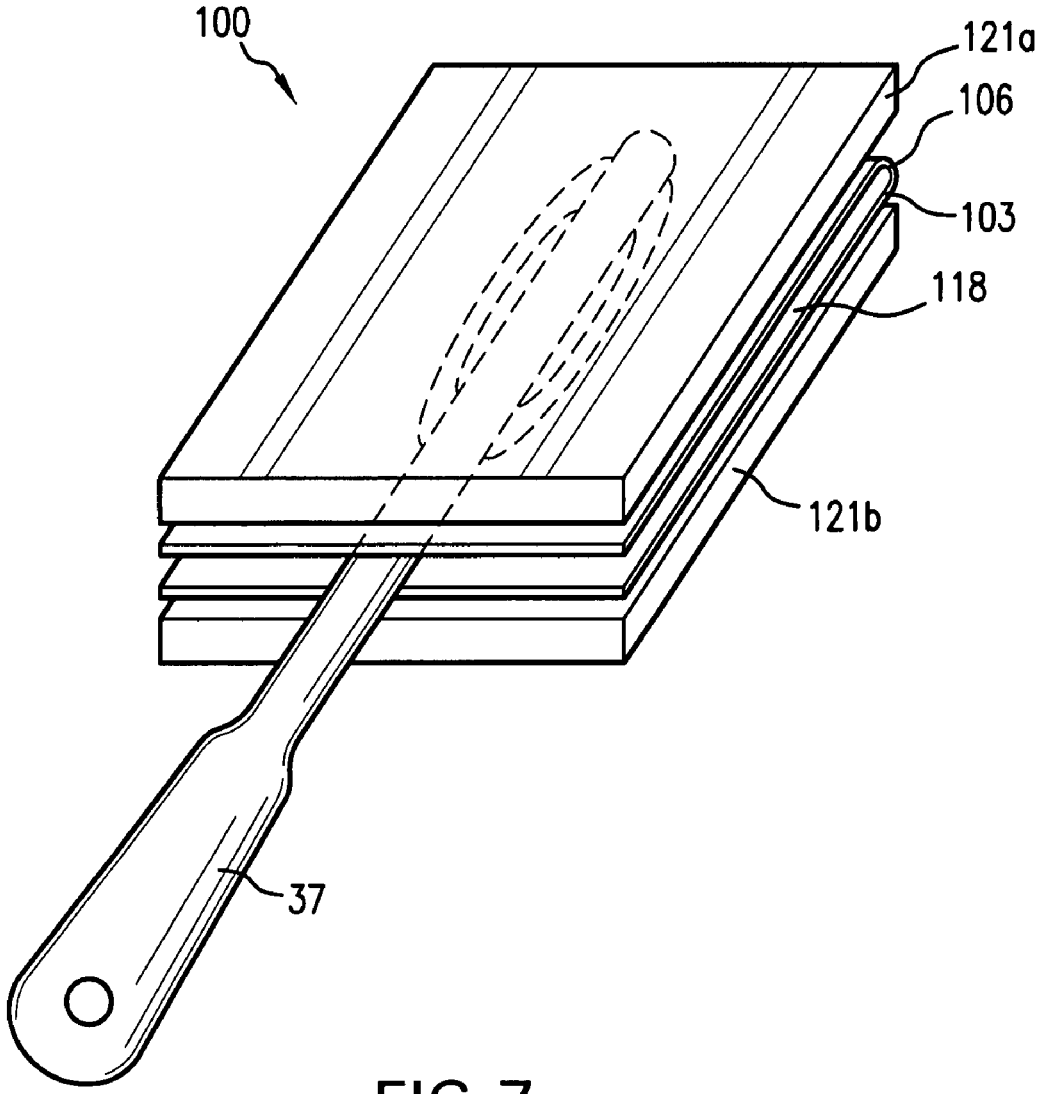
FIG. 7 is a perspective view of a cleaning tool according to a fourth embodiment of the present invention.
Figure 8:
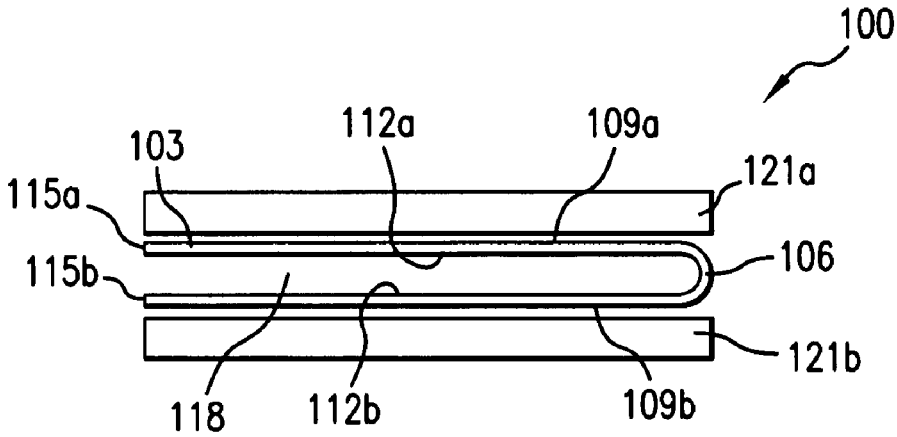
FIG. 8 is a side view of the cleaning pad of FIG. 7.

A fourth embodiment of a cleaning pad 100 according to the present invention is show in FIGS. 7 and 8. As shown, the top sheet 103 has a length that allows it to be folded along C-shaped fold line 106, generally at a middle portion to form two outer surfaces 109*a* and 109*b*, and two inner surfaces 112*a* and 112*b*. In this manner the longitudinal ends 115*a*, 115*b* of each half of the top sheet 103 are generally coterminous. The two inner surfaces 112*a*, 112*b* are in a face-to-face relationship and the outer surfaces 109*a*, 109*b* are oppositely disposed. A pocket 118 is also formed between the inner surfaces 112*a*, 112*b*. A pair of fiber bundles 121*a* and 121*b* are disposed adjacent to each of the outer surfaces 109*a*, 109*b*. Thus the cleaning pad 100 has two cleaning surfaces. In this way, both surfaces of the cleaning pad 100 exhibit dust wiping capabilities and may be used when cleaning narrow spaces, for example, or the cleaning pad 100 rotated to effectively double the dust cleaning capacity. Each of the cleaning surfaces may also include second sheets, which may or may not include transverse cuts and strips (not shown—see FIGS. 3 and 4).

Figure 9:
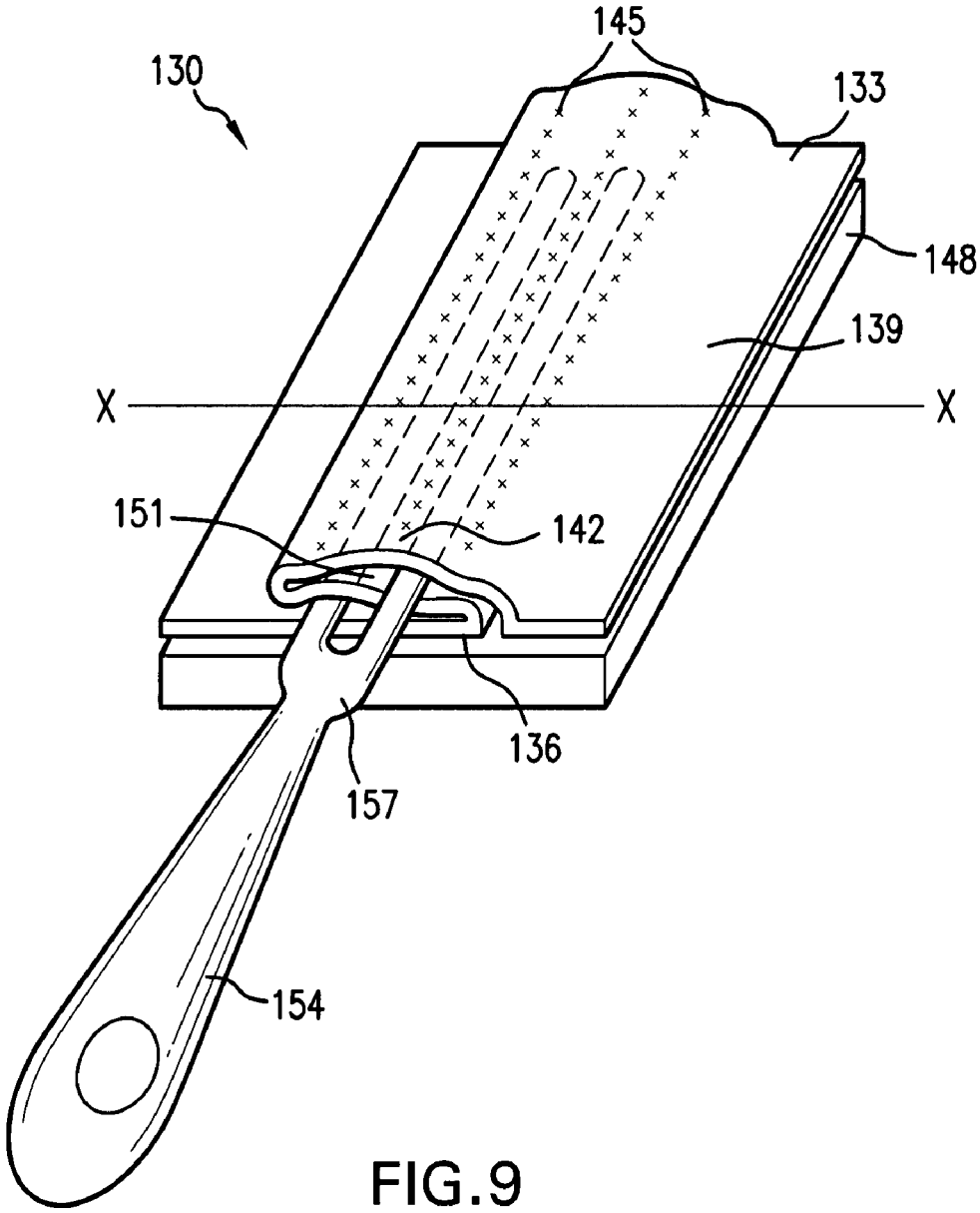
FIG. 9 is a perspective view of a cleaning pad according to a fifth embodiment of the present invention.
Figure 10:
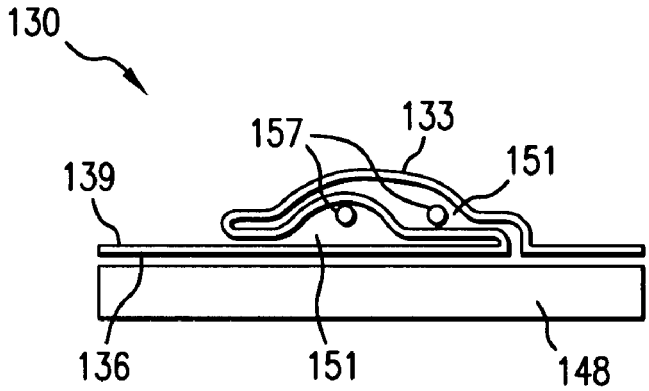
FIG. 10 is an end view of the cleaning pad of FIG. 9.

Referring now to FIGS. 9 and 10, an alternative folding scheme for the top sheet in a fifth embodiment of the cleaning pad 130 according to the present invention is shown. The top sheet 133 is folded over along the longitudinal direction in a generally Z-shaped manner. Similar to the other embodiments, the top sheet 133 includes a cleaning portion 136 and back portion 139. The Z-shaped top sheet 133 has a central region 142 formed by generally parallel bond lines 145. The bond lines 145 also preferably bonds the fiber bundle 148 to the cleaning portion 136 of the top sheet 133. Because bond lines 145 are preferably placed adjacent to the edges of the Z-shaped fold in the central region 142, a plurality of pockets 151 are formed. A handle 154 having a generally U-shaped portion 157 is inserted into two of the pockets 151 in order to affix the handle 154 to the cleaning pad 130. This is more clearly shown in FIG. 10 (which is a view taken along line X-X of FIG. 9). This configuration also more readily allows the handle 154 to be inserted into the pockets 151 of the top sheet 133 from either end. It will be appreciated by those skilled in the art that this fifth embodiment may include multiple fiber bundles 148, as well as a bottom sheet and/or a middle sheet, as described in reference to embodiments shown in any of the prior embodiments, for example those shown in FIGS. 3-7. Moreover, either or all of the top sheet 133 and any other bottom or middle sheet may have strips similar to those shown in FIGS. 3 and 4.

Figure 11:
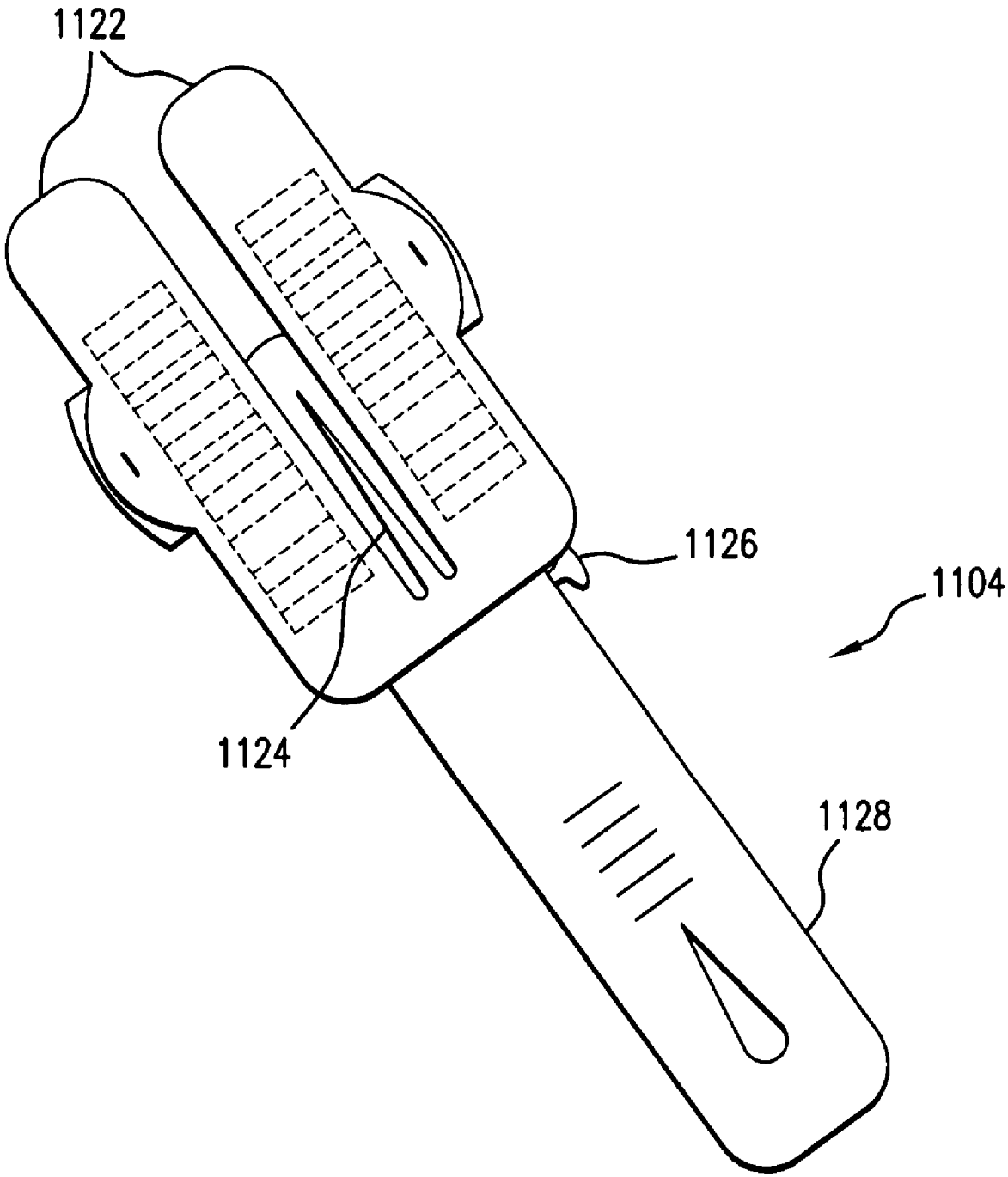
FIG. 11 is a top view of a handle that may be used to hold a cleaning pad in accordance with various embodiments of the invention.

FIG. 11 illustrates a top view of a handle 1104 that may be used to hold a cleaning pad in accordance with various embodiments of the present invention. Handle 1104 includes at least one support region 1122, a clip 1124, a hinge 1126, and a grip region 1128. A cleaning pad may be placed on the support region 1122 and can be held to the handle with clip 1124. Alternatively support region 1122 may be inserted into the holding space of a cleaning pad. The cleaning pad can then be held together with the pad using clip 1124. Once the cleaning is done, cleaning pad may be disposed and handle 1104 may be reused with another cleaning pad.

Hinge 1126 helps handle 1104 to be folded so as to reduce the storage space. The handle can then be re-extended from its storage position when it is desired to use the cleaning tool. Grip region 1128 helps a user to hold handle 1104. Further, handle 1104 may be sized and shaped to enable a user wipe the inside of a car window. Handle 1104 may also be sized and shaped to enable a user wipe the dashboard of a car.

It is possible to adopt a variety of handle structures to permit the handle to be properly secured by the pocket of the pad while cleaning. FIGS. 12A-12E illustrate various embodiments of a handle that may be used to hold a cleaning pad in accordance with various embodiment of the present invention.

Figure 12A:
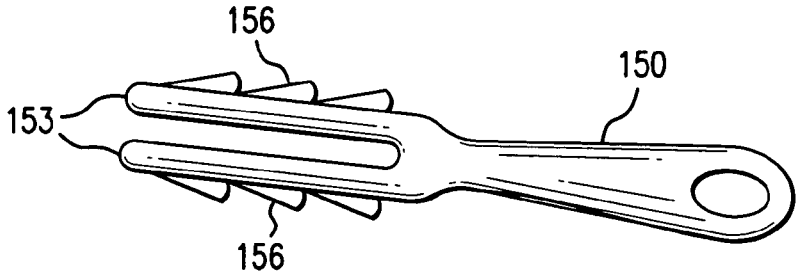
FIG. 12, consisting of FIGS. 12A, 12B, 12C, 12D, and 12E, shows various embodiments of a handle for the cleaning tool of the present invention.

FIG. 12A illustrates a handle 150 with two arms 153. Each of the two arms has multiple frictional extensions 156 that are triangular in shape. When the arms are inserted into the holding space of a cleaning pad, the frictional extensions help the handle to hold the cleaning pad by means of frictional engagement. With this type of handle it is preferred that the center bond line discussed above be included to enhance the frictional engagement of the arms 153.

Figure 12B:
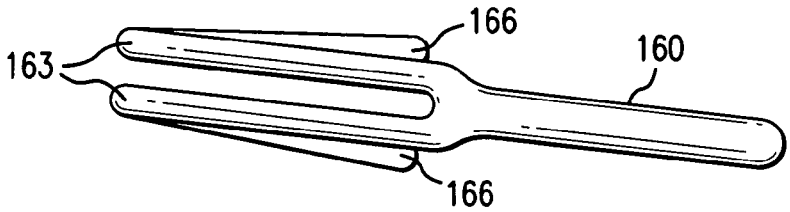

FIG. 12B illustrates a handle 160 with two arms 163. Each of the two arms has one frictional extension. The extension is triangular in shape 166.

Figure 12C:
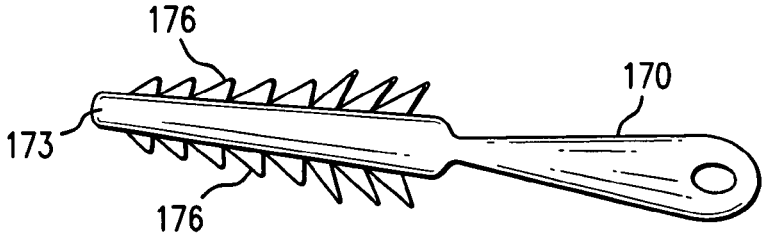

FIG. 12C illustrates a handle 170 with one arm 173. The arm has multiple frictional extensions that are triangular in shape 176.

Figure 12D:
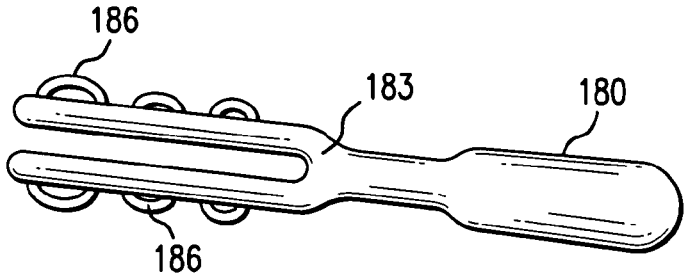

In FIG. 12D there is shown a handle 180 a generally U-shaped insertion portion 183 having a plurality, in this example six (6), of resilient loops 186 for frictional engagement with the interior spaces of the pockets.

Figure 12E:
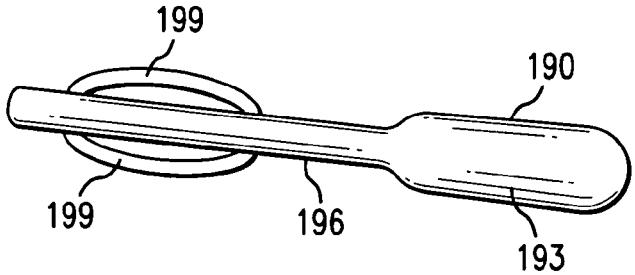

In the configuration of FIG. 12E a handle 190 has a grip portion 193 and an insert portion 196. The insert portion 196 includes at least one, and preferably two, resilient loops 199. When inserted into a pocket (see FIG. 7 for example) the resilient loops 199 have a slight interference fit with the interior of the pocket, helping to prevent accidental disengagement of the handle 190 from the cleaning pad.

These configurations allow the handles to accommodate a wide variety of pocket sizes, thus providing manufacturing flexibility for the cleaning pads such as in the spacing and/or positioning of the bond lines.

It may be desirable to increase the dust holding capability of the cleaning pad of the present invention, such as by providing an additive to either or both of the cleaning sheet or the fiber bundle. If the cleaning pad is also comprised of the middle or bottom sheets, they too can be provided with the additive. This additive can take many forms which will tend to increase the tackiness of the various components of the cleaning pad. For example, the additive may be a chemical pretreatment in which a paraffin or oil based product is applied to the sheets and/or the fiber bundle. Alternatively, or in addition thereto, the fiber bundle strands may be exposed to a corona treatment to impose and electrical charge to the fiber bundles to impart a static electrical charge which "attracts" dust and dirt particles to the cleaning pad.

Various other embodiments are possible and are within the spirit of the invention. The aforementioned embodiments are simply provided for explanatory purposes, and are in no way intended to restrict the scope of the invention in any manner. The cleaning pad may be made from various kinds of materials available in the field and known to a person skilled in the art. While specific embodiments of the invention have been described in detail, it will be appreciated by those skilled in the art that various modifications and alterations would be developed in light of the overall teachings of the disclosure. Accordingly, particular arrangements described are meant to be illustrative only and not limiting as to the scope of the invention, which is to be given the full breadth of the appended claims and in any and all equivalents thereof.

What is claimed is:

1. A cleaning tool, said cleaning tool comprising a cleaning pad and a handle, the cleaning pad further comprising:

a single top sheet comprising a proximal end, a distal end, and an intermediate portion, wherein the distal end of the top sheet is folded over the intermediate portion spaced apart from the proximal portion so as to form two outer surfaces and two inner surfaces, the two inner surfaces being in face to face relation to one another so as to form a pocket between the two inner surfaces;

a fiber bundle attached to one of the two outer surfaces of the single top sheet; and wherein the handle is configured to be removably attachable within the pocket.

2. The cleaning tool as claimed in claim 1, wherein said top sheet is provided with a plurality of transverse strips.

3. The cleaning tool as claimed in claim 1, wherein the top sheet is bonded to the fiber bundle.

4. The cleaning tool as claimed in claims 1, further including a second fiber bundle disposed adjacent to the other of the outer surfaces.

5. The cleaning tool as claimed in claim 1, wherein said outer surface and inner surface are joined to one another by two generally parallel bonding lines on either side of a longitudinal centerline of said cleaning pad, and another bonding line at the longitudinal centerline to thereby define two pockets extending in the longitudinal direction of the cleaning pad.

6. The cleaning tool as claimed in claim 1, wherein the top sheet and said fiber bundle are joined at the longitudinal centerline of the cleaning pad by one or more bonding means including thermoplastic and fusion-bonding.

7. The cleaning tool as claimed in claim 1, wherein said top sheet is made of a non-woven fabric comprising thermoplastic fibers.

8. The cleaning tool as claimed in claim 1, wherein said top sheet is made of a thermoplastic resin film.

9. The cleaning tool as claimed in claim 1, wherein said fiber bundle comprises heat-fusible thermoplastic fibers.

10. The cleaning tool as claimed in claim 1, wherein said fiber bundle is an opened tow that is laid on and cut together with said sheets.

11. The cleaning tool as claimed in claim 1, further including a bottom sheet disposed adjacent to the fiber bundle opposite to the top sheet.

12. The cleaning tool as claimed in claim 11, further including a second fiber bundle disposed adjacent to the bottom sheet opposite the first fiber bundle.

13. The cleaning tool as claimed in claims 5, further including a second fiber bundle disposed adjacent to the other of the outer surfaces.

14. The cleaning tool as claimed in claim 1, further including a second fiber bundle disposed adjacent to the other of the outer surfaces, wherein the top sheet and said first and second fiber bundles are joined at the longitudinal centerline of the cleaning pad by one or more bonding means including thermoplastic and fusion-bonding.

15. A cleaning pad comprising:

a single top sheet comprising a proximal end, a distal end and an intermediate portion, the single top sheet having a fold line so that the distal end of the top sheet is folded over the intermediate portion spaced apart from the proximal portion so as to form two outer surfaces and two inner surfaces, the two inner surfaces defining a pocket therebetween, one of the two outer surfaces of the top sheet defining a cleaning portion of the top sheet; and a fiber bundle disposed adjacent to the cleaning portion.

16. The cleaning pad as claimed in claim 15, wherein the fold line is a generally C-shaped fold line wherein the C-shaped fold line is positioned adjacent to a longitudinal end of the fiber bundle.

17. The cleaning pad as claimed in claim 15, wherein the fold line is a generally Z-shaped fold line along a longitudinal direction of the cleaning pad.

18. The cleaning pad as claimed in claim 15, further including a bottom sheet disposed adjacent to the fiber bundle opposite the top sheet.

19. The cleaning pad as claimed in any of claims 18, wherein the bottom sheet includes a plurality of transverse cut lines forming a plurality of transverse strips.

20. The cleaning pad as claimed in any of claims 15, further including a second fiber bundle disposed adjacent to the fiber bundle opposite the top sheet.

21. The cleaning pad as claimed in claim 20, further including a middle sheet disposed between the fiber bundle and the second fiber bundle.

22. The cleaning pad as claimed in claim 21, further including a bottom sheet disposed adjacent to the second fiber bundle opposite the middle sheet.

23. The cleaning pad as claimed in claim 15, wherein said top sheet is provided with a plurality of transverse strips.

24. The cleaning pad as claimed in claim 23, wherein either of said middle sheet or bottom sheet is provided with a plurality of transverse strips.

25. The cleaning pad as claimed in any of claims 15, further including at least one longitudinally positioned bonding line for bonding the top sheet to the fiber bundle.

26. The cleaning pad as claimed in claim 25, wherein the top sheet and the fiber bundle are bonded by one or more bonding means including thermoplastic and fusion-bonding.

27. The cleaning pad as claimed in claim 15, wherein said top sheet is made of either a non-woven fabric comprising thermoplastic fibers or a thermoplastic resin film.

28. The cleaning pad as claimed in claim 15, wherein said fiber bundle comprises heat-fusible synthetic fibers.

29. The cleaning pad as claimed in claim 16, further including a bottom sheet disposed adjacent to the fiber bundle opposite the top sheet.

30. The cleaning pad as claimed in claim 29, further including a second fiber bundle disposed adjacent to the fiber bundle opposite the top sheet.

31. The cleaning pad as claimed in claim 17, further including a bottom sheet disposed adjacent to the fiber bundle opposite the top sheet.

32. The cleaning pad as claimed in any of claims 31, further including a second fiber bundle disposed adjacent to the fiber bundle opposite the top sheet.

33. A cleaning pad comprising:

a single top sheet comprising a proximal portion, a distal portion and an intermediate portion, the distal end of the top sheet being folded over the intermediate portion spaced apart from the proximal portion so as to form tow outer surfaces and two inner surfaces, the two inner surfaces defining a pocket therebetween, one of the two outer surfaces defining a cleaning portion of the top sheet;

a first fiber bundle attached to the cleaning portion;

a middle sheet disposed adjacent to the first fiber bundle opposite to the top sheet;

a second fiber bundle disposed adjacent to the middle sheet opposite the first fiber bundle;

a bottom sheet disposed adjacent to the second fiber bundle opposite the middle sheet; and a handle configured to be removably attachable within the pocket.

34. The cleaning pad as claimed in claim 33, wherein at least one of the top sheet, the middle sheet the first fiber bundle or the second fiber bundle have an additive to increase its attractive properties.

35. The cleaning pad as claimed in claim 34, wherein the additive comprises one of a paraffin or oil-based pre-treatment.

36. The cleaning pad as claimed in claim 34, wherein the additive comprises an electrical charge.

37. A cleaning tool comprising:

a cleaning pad comprising a single top sheet, the single top sheet comprising a proximal end, a distal end and an intermediate portion, the distal end of the single top sheet being folded over the intermediate portion spaced apart form the proximal portion so as to form two outer surfaces and two inner surfaces, the two inner surfaces being in face to face relation to one another so as to form a pocket;

a fiber bundle attached to one of the two outer surfaces of the single top sheet; and a handle for holding the cleaning pad, the handle being configured to be removably attachable within the pocket, wherein the handle comprises a hinge, the hinge allowing the handle to be folded.

38. The cleaning tool as claimed in claim 37, wherein the handle is a reusable handle.

39. The cleaning tool as claimed in claim 37, wherein the handle is sized and shaped to wipe the inside of a car window.

40. The cleaning tool as claimed in claim 37, wherein the handle is sized and shaped to wipe the dashboard of a car.

41. The cleaning tool as claimed in claim 37, wherein the handle holds the cleaning pad by frictional engagement.

42. The cleaning tool as claimed in claim 37, wherein the handle comprises a plurality of arms.

43. The cleaning tool as claimed in claim 37, wherein the handle comprises a plurality of frictional extensions.

44. The cleaning tool as claimed in claim 43, wherein each of the plurality of frictional extensions is triangular in shape.

45. The cleaning tool as claimed in claim 43, wherein each of the plurality of frictional extensions is semi-circular in shape.

* * * * *